US010029161B2

(12) United States Patent
Knutson et al.

(10) Patent No.: US 10,029,161 B2
(45) Date of Patent: Jul. 24, 2018

(54) GOLF CLUB HAVING REMOVABLE WEIGHT

(71) Applicant: Acushnet Company, Fairhaven, MA (US)

(72) Inventors: Scott A. Knutson, Escondido, CA (US); Noah de la Cruz, San Diego, CA (US); Andrew McCarthy, Carlsbad, CA (US); Grant M. Martens, Carlsbad, CA (US); Michael E. Franz, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 87 days.

(21) Appl. No.: 15/339,797

(22) Filed: Oct. 31, 2016

(65) Prior Publication Data

US 2018/0117427 A1 May 3, 2018

(51) Int. Cl.

| | |
|---|---|
| ***A63B 53/06*** | (2015.01) |
| ***A63B 53/04*** | (2015.01) |
| ***A63B 60/02*** | (2015.01) |

(52) U.S. Cl.

CPC ..... *A63B 53/06* (2013.01); *A63B 53/0466* (2013.01); *A63B 60/02* (2015.10); *A63B 2053/0433* (2013.01); *A63B 2053/0491* (2013.01); *A63B 2053/0495* (2013.01)

(58) Field of Classification Search

CPC ..... A63B 53/06; A63B 2053/0491; A63B 2053/0433; A63B 2053/0495

USPC ..... 473/334–339, 341

See application file for complete search history.

(56) References Cited

U.S. PATENT DOCUMENTS

| | | | | |
|---|---|---|---|---|
| 1,322,182 | A | 11/1919 | Duncan | |
| 1,534,600 | A | 4/1925 | Mattern | |
| 2,155,383 | A | 4/1939 | Carr | |
| 3,220,733 | A | 11/1965 | Saleeby | |
| 4,150,464 | A | 4/1979 | Tracy | |
| 4,869,507 | A | 9/1989 | Sahm | |
| 5,230,509 | A | 7/1993 | Chavez | |
| 5,316,305 | A | 5/1994 | McCabe | |
| 5,794,316 | A | 8/1998 | Anscher | |
| 5,935,019 | A | 8/1999 | Yamamoto | |
| 6,123,627 | A | 9/2000 | Antonious | |
| 6,458,044 | B1 | 10/2002 | Vincent | |
| 6,902,432 | B2 | 6/2005 | Morikawa | |
| 7,166,041 | B2 | 1/2007 | Evans | |
| 7,604,548 | B2 | 10/2009 | Cole | |
| 7,628,711 | B2 | 12/2009 | Akinori | |
| 7,758,452 | B2 | 7/2010 | Soracco | |
| 7,775,905 | B2 | 8/2010 | Beach | |
| 8,192,303 | B2 | 6/2012 | Ban | |
| 8,444,505 | B2 * | 5/2013 | Beach | A63B 53/0466 473/334 |
| 9,387,376 | B1 | 7/2016 | Hall | |
| 9,387,377 | B2 | 7/2016 | Liang | |
| 9,682,296 | B1 * | 6/2017 | Myers | A63B 53/0466 |
| 9,694,261 | B2 * | 7/2017 | Nunez | A63B 53/06 |

(Continued)

*Primary Examiner* — Benjamin Layno

(74) *Attorney, Agent, or Firm* — Michael J. Mancuso

(57) ABSTRACT

A golf club head includes a club head body and a weight member that is secured to the body. The weight member is constructed to utilize lateral forces to couple to the head body to minimize the structure required to retain the weight member, and the weight member is preferably constructed so that it has a low profile.

20 Claims, 11 Drawing Sheets

(56) References Cited

U.S. PATENT DOCUMENTS

| | | | | |
|---|---|---|---|---|
| 9,744,415 | B2 * | 8/2017 | Frame | A63B 53/06 |
| 2006/0122004 | A1 | 6/2006 | Chen | |
| 2008/0132353 | A1 | 6/2008 | Hsiao | |
| 2009/0143167 | A1 | 6/2009 | Evans | |
| 2009/0221380 | A1 * | 9/2009 | Breier | A63B 53/0466 473/288 |
| 2015/0321055 | A1 * | 11/2015 | Golden | A63B 53/0466 473/338 |

* cited by examiner

GOLF CLUB HAVING REMOVABLE WEIGHT

FIELD OF THE INVENTION

The invention relates to golf clubs, and more particularly, to golf club heads having a removable weight.

BACKGROUND OF THE INVENTION

The trend of lengthening golf courses to increase their difficulty has resulted in a high percentage of amateur golfers constantly searching for ways to achieve more distance from their golf shots. The golf industry has responded by providing golf clubs specifically designed with distance and accuracy in mind. The size of wood-type golf club heads has generally been increased while multi-material construction and reduced wall thicknesses have been included to provide more mass available for selective placement through the head. The discretionary mass placement has allowed the club to possess a higher moment of inertia (MOI), which translates to a greater ability to resist twisting during off-center ball impacts and less of a distance penalty for those off-center ball impacts.

Various methods are used to selectively locate mass throughout golf club heads, including thickening portions of the body casting itself or strategically adding a separate weight element during the manufacture of the club head. An example, shown in U.S. Pat. No. 7,186,190, discloses a golf club head comprising a number of moveable weights attached to the body of the club head. The club head includes a number of threaded ports into which the moveable weights are screwed. Though the mass characteristics of the golf club may be manipulated by rearranging the moveable weights, the cylindrical shape of the weights and the receiving features within the golf club body necessarily moves a significant portion of the mass toward the center of the club head, which may not maximize the peripheral weight of the club head or the MOI.

Alternative approaches for selectively locating mass in a club head utilize the incorporation of composite structures of multiple materials. These composite structures often utilize two, three, or more materials, including various metallic and non-metallic materials, that have different physical properties including different densities. An example of this type of multi-material head is shown in U.S. Pat. No. 5,720,674. The club head comprises an arcuate portion of high-density material bonded to a recess in the back-skirt. Because the different materials included in the club head must be coupled, for example by welding, swaging, or using bonding agents such as epoxy, they may be subject to delamination or corrosion over time. This component delamination or corrosion results in decreased performance in the golf club head and can lead to club head failure.

Though many methods of optimizing the mass properties of golf club heads exist, there remains a need in the art for a golf club head comprising at least a removable weight having secure attachment and a low-profile so that the weight does not protrude into the center of the club head and negatively affect the location of the center of gravity.

SUMMARY OF THE INVENTION

The present invention is directed to a golf club head having at least one weight receptacle and at least one movable or removable weight member.

In an embodiment, a golf club head includes a club head body, a weight mount and a weight member. The club head body comprises a plurality of body members that combine to define a hollow body. The body members include a face defining a ball-striking surface, a sole, a crown, and a skirt. The sole extends aftward from a lower edge of the face, the crown extends aftward from an upper edge of the face, and the skirt extends between the sole and the crown around a perimeter of the body. The weight mount is disposed on at least one of the body members, and the weight mount defines a perimeter wall. The weight member includes a weight body defining a side wall and at least two spring features. Each spring feature is defined by an elongate aperture extending through a thickness of the weight body at a location spaced from the side wall. The weight mount is sized so that the spring features abut the perimeter wall of the weight mount. The spring features are at least partially flexed laterally by the abutment of the spring feature with the perimeter wall when the weight member is disposed in the weight mount.

In another embodiment, a golf club head including a club head body, a weight mount, and a weight member. The club head body comprises a plurality of body members that combine to define a hollow body. The body members include a face defining a ball-striking surface, a sole, a crown, and a skirt. The sole extends aftward from a lower edge of the face, the crown extends aftward from an upper edge of the face, and the skirt extends between the sole and the crown around a perimeter of the body. The weight mount is disposed on at least one of the body members. The weight mount is a slot extending through at least a portion of the thickness of the body member and is elongate. Sidewalls of the slot are generally parallel. The weight member includes a weight body, a spring clip, and a locking member. The weight body includes an outer portion disposed outward of the body member, an inner portion, and a clip portion interposed between the outer portion and the inner portion. The inner portion extends through the slot toward in interior of the club head body. The spring clip is disposed on the clip portion and includes a plurality of arms separated by a flexure. The width of an outer engagement surface of the spring clip is greater than the width of the slot when the spring clip is in a free state so that the spring clip is compressed when the weight member is installed in the slot. The locking member extends through the outer portion and into the clip portion of the weight body.

In another embodiment, a golf club head includes a club head body, a weight mount and a weight member. The club head body comprising a plurality of body members that combine to define a hollow body. The body members include a face defining a ball-striking surface, a sole, a crown, and a skirt. The sole extends aftward from a lower edge of the face, the crown extends aftward from an upper edge of the face, and the skirt extends between the sole and the crown around a perimeter of the body. The weight mount disposed on at least one of the body members. The weight mount is a spring clamp that includes at least one flexible arm. The spring clamp defines an opening that is at least partially defined by the flexible arm. The flexible arm includes a fixed end and a free end, the fixed end is fixedly coupled to the body member, and the free end is movable between an opened position and a closed position. The weight member that includes a weight body, and the weight body includes a clamp portion that is disposed in the opening of the spring clamp. The flexible arm forcibly abuts the clamp portion when the free end is in the closed position.

The spring clamp is in an always on configuration so that it is naturally clamped on the weight member in the slot.

DETAILED DESCRIPTION

Figure 1:
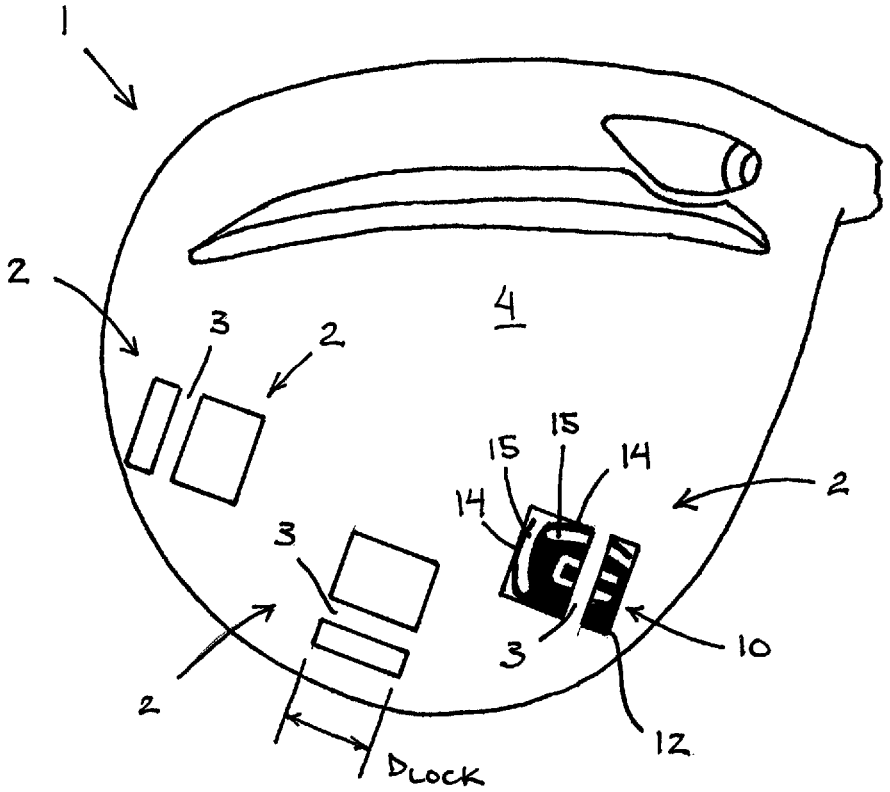
FIG. 1 is a bottom view of a golf club head including a weight member in accordance with the present invention.
Figure 3:
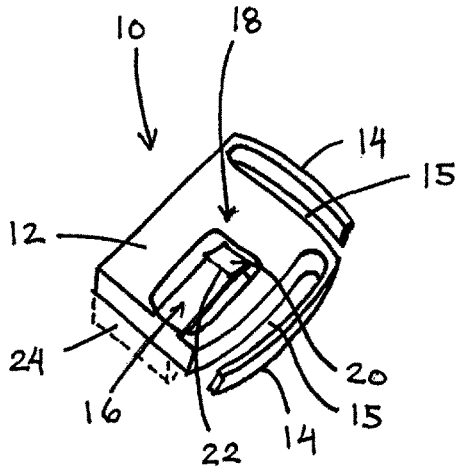
FIG. 3 is a perspective view of the weight member included in the golf club head of FIG. 1.
Figure 2:
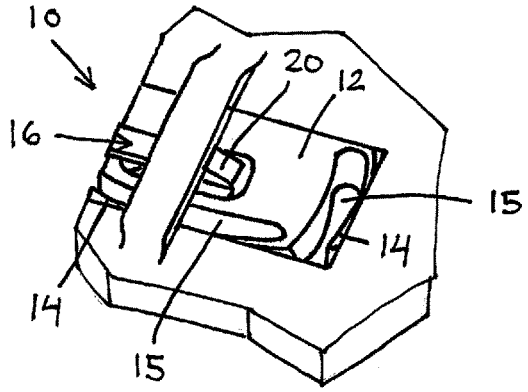
FIG. 2 is a perspective view of a portion of a golf club head of FIG. 1.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Many weight structures utilize attachment mechanisms that primarily utilize a force in the direction of an axis that is orthogonal to the outer contour of golf club head for attaching weight member to the golf club head. According to the present invention, weight members that primarily utilize forces that are generally directed parallel or tangential to the outer contour of the golf club head and lateral to the weight member are described. Utilizing attachment configurations that primarily interact with the surrounding structure of the golf club head in parallel or tangentially to the outer contour of the golf club head reduces the amount of structure that extends toward the interior of the golf club head that would otherwise be required to retain the weight member.

In an aspect of the present invention, an embodiment of a weight member 10, having a low profile, includes a simple clip-in type attachment that does not require the use of a threaded fastener to couple the weight member 10 to the golf club head 1. Golf club head 1 has a hollow bodied construction that includes a face, a sole 4, a crown, a skirt, and a hosel that combine to define the hollow interior. As is well known in the art, the body may be formed by numerous methods and those methods may be used alone or in combination, and the club head body may include cast, stamped and/or forged components that are combined together. In an example, the head body may include a cast component including the sole, crown, skirt and hosel and a stamped face component that is welded to the cast component. In another example, the head body may include forged sole, crown, hosel, and face components that are welded together.

The face defines a ball-striking surface. The sole 4 extends aftward from a lower edge of the face. The crown extends from an upper edge of the face and the skirt extends between the sole 4 and crown and around the perimeter of the body. Golf club head 1 also includes a plurality of weight attachment structures, such as weight mounts 2. Weight member 10 includes a body 12, and three spring features. The spring features include two side wall spring features that are flexible arms 14 and a locking spring feature formed by a flexible locking arm 16 on another surface. Each flexible arm 14 is defined by an elongate aperture 15 that extends through the thickness of body 12 and that intersects the side wall of body 12.

The side wall spring features and locking arm 16 combine to prevent relative movement between the weight cartridge and the golf club head in three orthogonal axes, e.g., the X, Y and Z axes, so that the weight member is fully constrained from translation when the weight member is installed in a weight receptacle. In particular, the dimensions of the weight mount 2 are selected so that the portions abutting the flexible arms are narrower than the free width of the weight member at the flexible arms. As a result of those dimensions, the flexible arms 14 and locking arm 16 are at least partially flexed laterally and act upon the surrounding structure of the weight mount 2 and are compressed to exert lateral force on the surrounding structure to prevent translation of the weight member 10 in every direction, i.e., in three orthogonal axes.

The weight member 10 also includes a locking mechanism that selectively locks the weight member 10 into the golf club head 1 at one of the weight mount 2. The locking arm 16 may include a locking tooth 18 that prevents the weight member 10 from becoming dislodged and disengaging from the golf club head 1 during impact. In the illustrated embodiment, the locking arm 16 interacts with a locking feature on the weight mount 2, such as a bridge member 3 that forms an undercut portion in weight mount 2. Bridge member 3 extends across a portion of the weight member 10 when the weight member 10 is inserted into a weight mount 2. Locking tooth 18 includes a tapered surface 20 that abuts and slides past bridge member 3 when the weight member 10 is inserted into a weight mount 2. That contact forces locking arm 16 to flex so that the locking tooth 18 slips past bridge member 3, which allows the weight member 10 to be fully inserted into the weight mount 2. Bridge member 3 may also include a tapered abutment surface that gradually increases contact force between tooth 18 and bridge member 3. The weight member 10 and weight mount 2 are dimensioned so that when the weight member 10 is fully inserted, the tapered surface 20 of locking tooth 18 passes the contacting portion of bridge member 3 and a ledge 22 of locking tooth 18 engages a portion of bridge member 3. The engagement of the ledge 22 and bridge member 3 prevents the weight member 10 from disengaging the weight mount 2, but the weight member 10 may be removed by displacing locking tooth 18 relative to bridge member 3 so that the locking tooth 18 is able to slip past bridge member 3 to allow weight member 10 to be retracted from weight mount 2. It should be appreciated that the height of flexible arms 14 may differ from the overall thickness of the weight member 10. For example, an extension portion, shown by dashed portion 24, may be included to increase the volume of weight member 10. Additionally, ledge 22 may be replaced with a second tapered surface that allows the weight member 10 to be removed without separately flexing locking arm 16 to disengage the locking tooth 18 from bridge member 3. The taper of the second tapered surface is preferably steeper than tapered surface 20.

Figure 4:
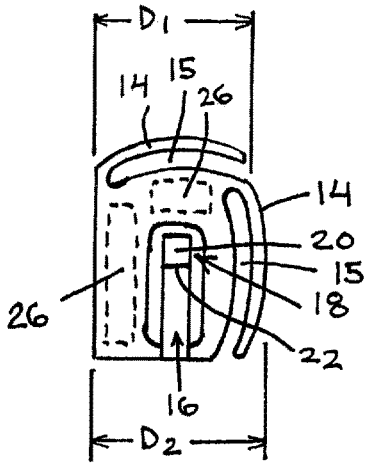
FIG. 4 is a front view of the weight member that may be included in the golf club head of FIG. 1.
Figure 5:
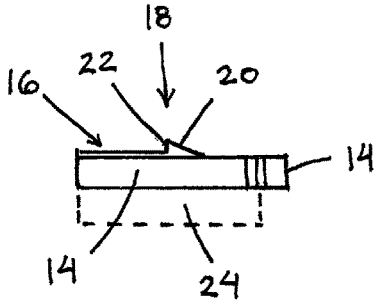
FIG. 5 is a side view of the weight member of FIG. 4.
Figure 6:
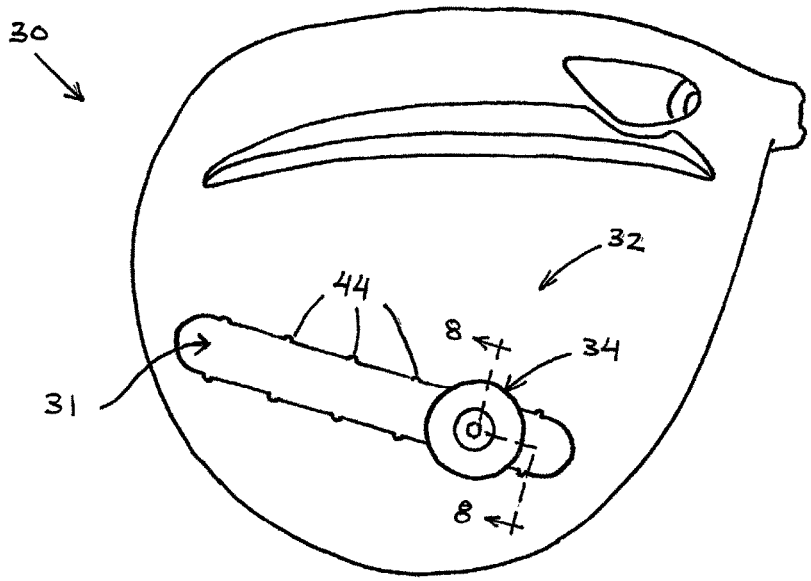
FIG. 6 is a bottom view of a golf club including another weight member in accordance with the present invention.
Figure 7:
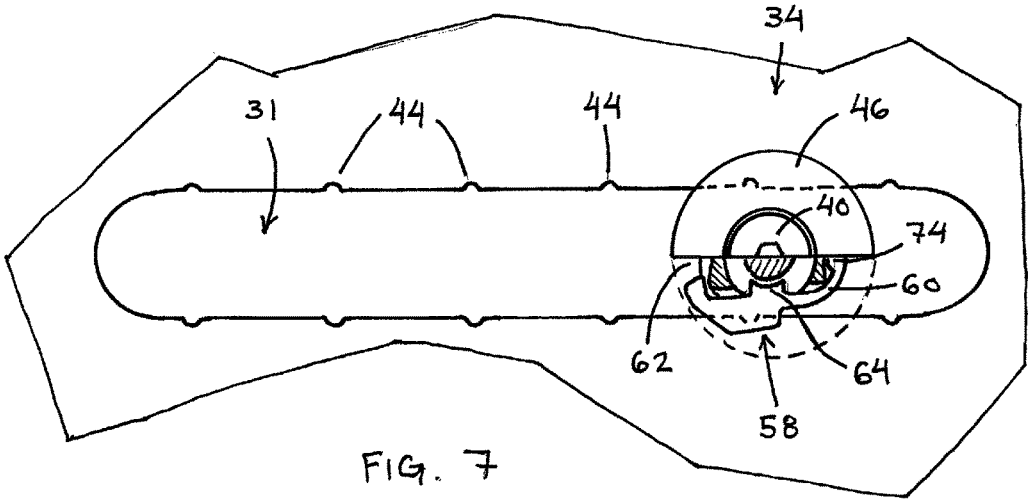
FIG. 7 is a bottom view of a portion of the golf club head of FIG. 6.
Figure 8:
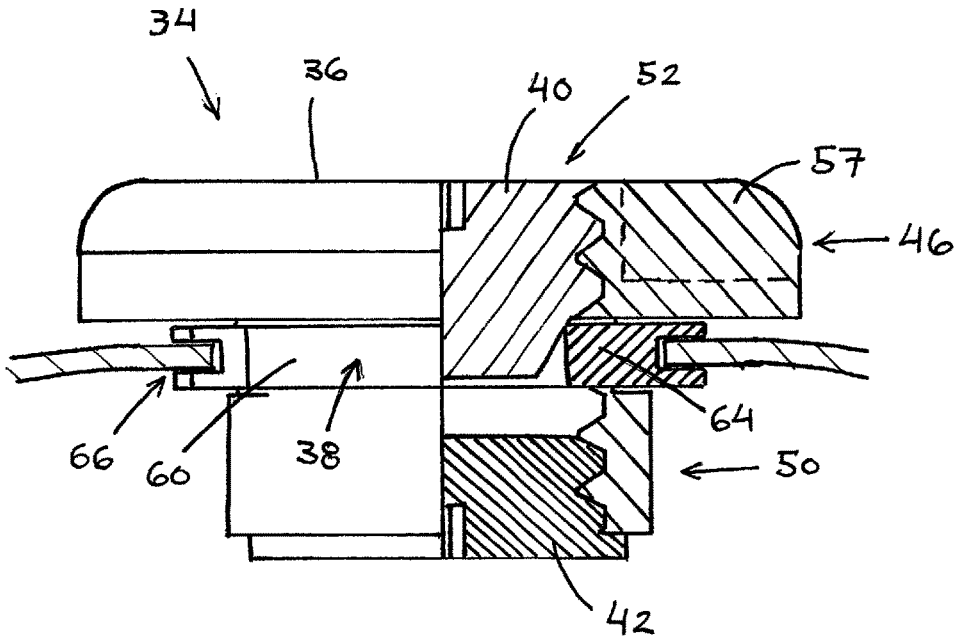
FIG. 8 is a partial cross-section of the golf club head of FIG. 6, as shown by line 8-8.
Figure 9:
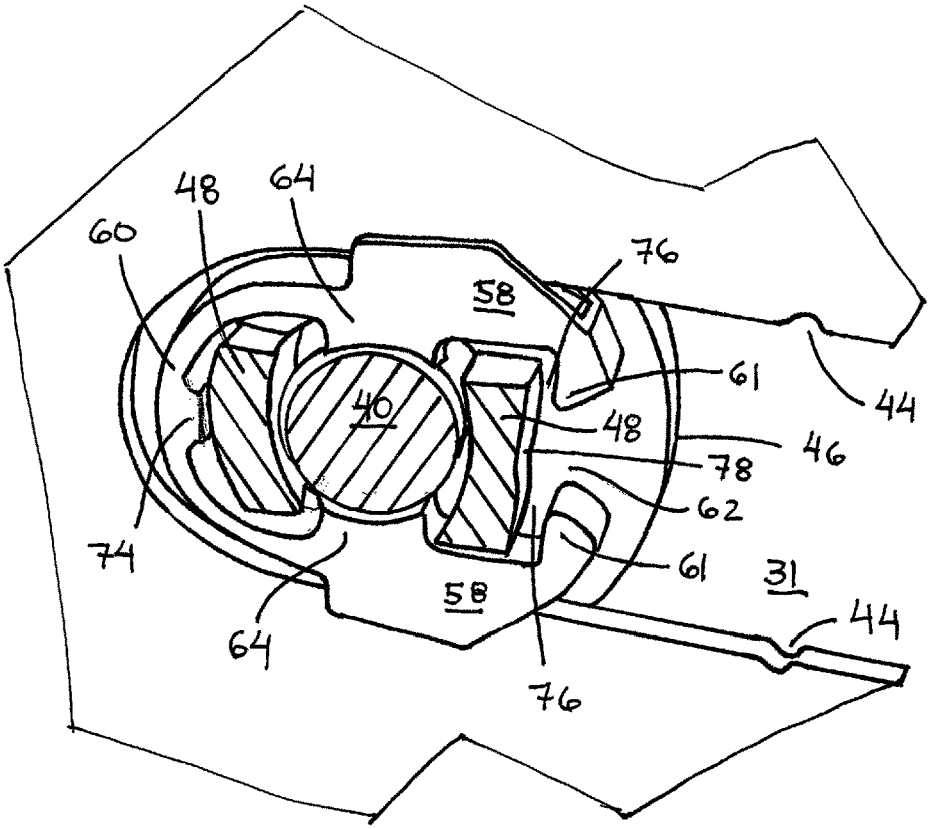
FIG. 9 is a perspective view showing a partial cross-section of a portion of the golf club head of FIG. 6.
Figure 10:
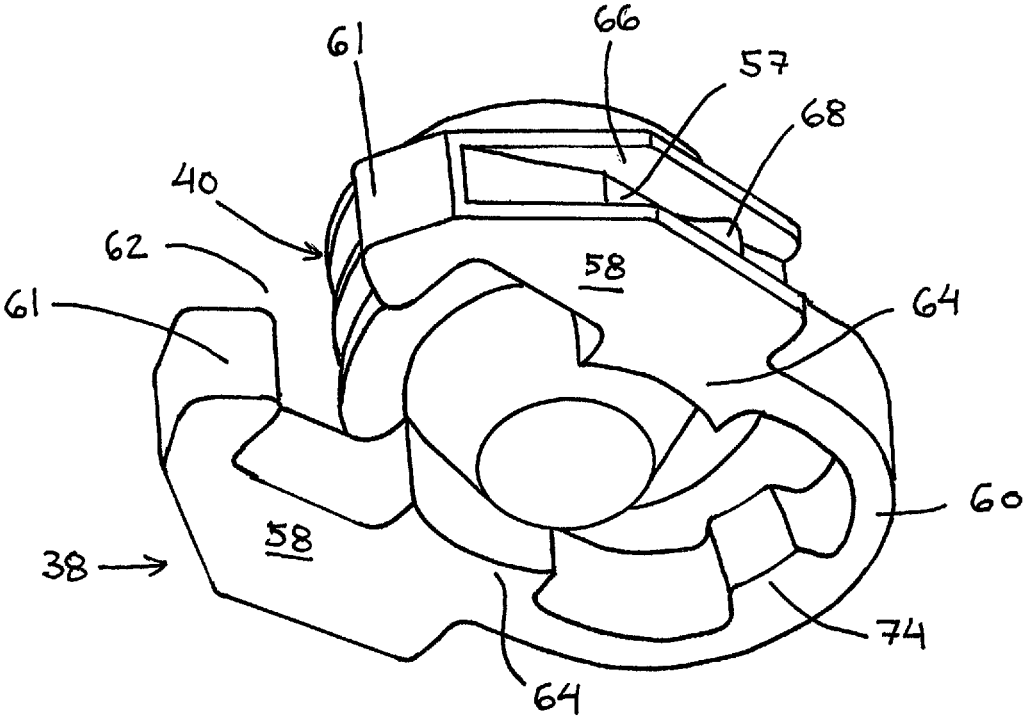
FIG. 10 is a perspective view of a portion of the weight member included in the golf club head of FIG. 6.
Figure 11:
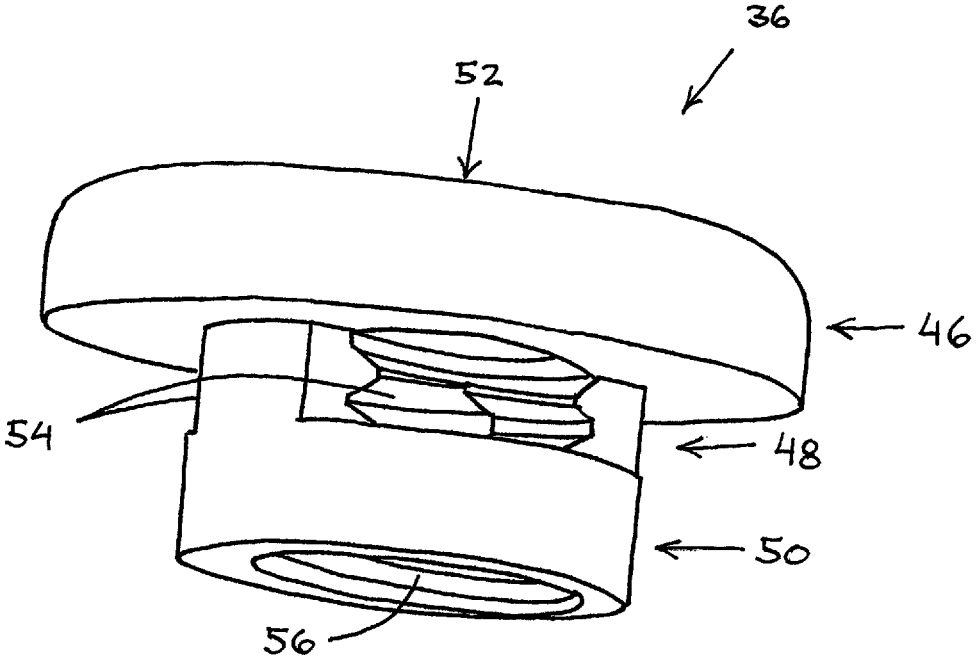
FIG. 11 is a perspective view of a portion of the weight member included in the golf club head of FIG. 6.
Figure 12:
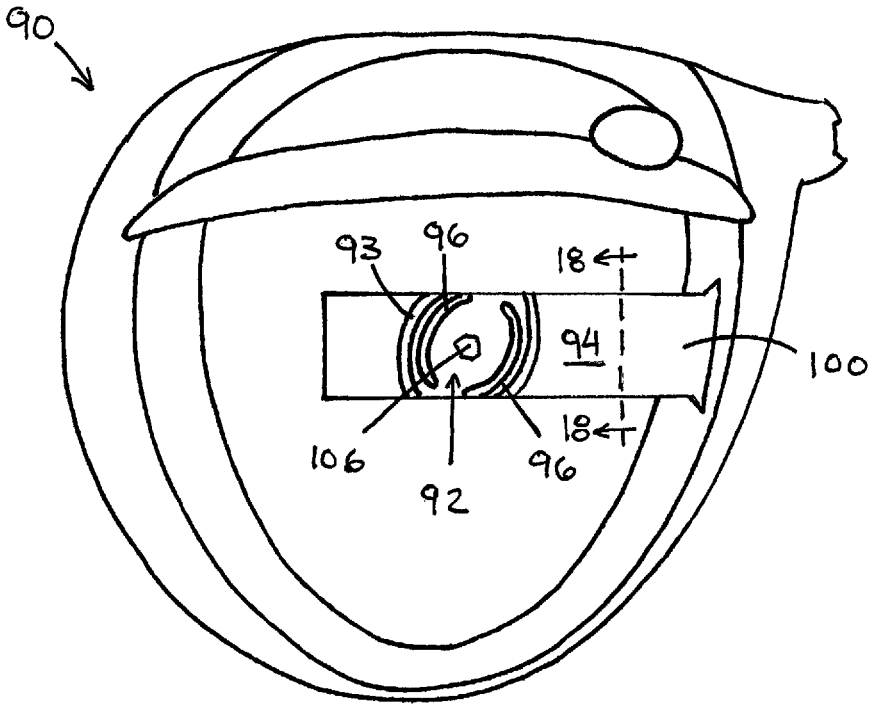
FIG. 12 is a bottom view of a golf club including another weight in accordance with the present invention.
Figure 13:
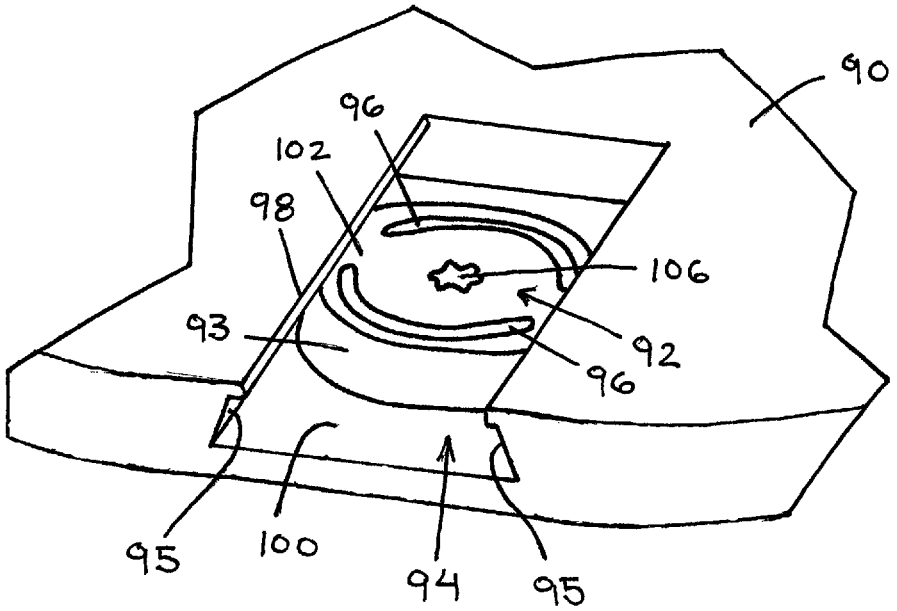
FIG. 13 is a perspective view of a portion of the golf club head of FIG. 12.
Figure 14:
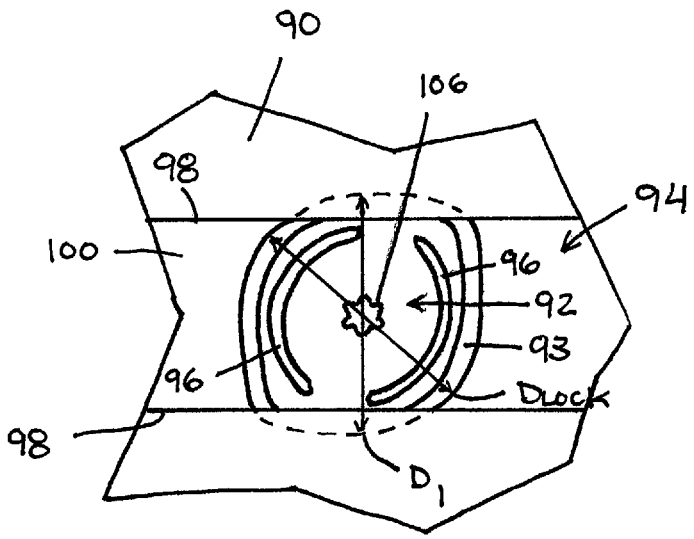
FIG. 14 is a bottom view of a portion of the golf club head of FIG. 12, illustrating a weight member in an unlocked orientation.
Figure 15:
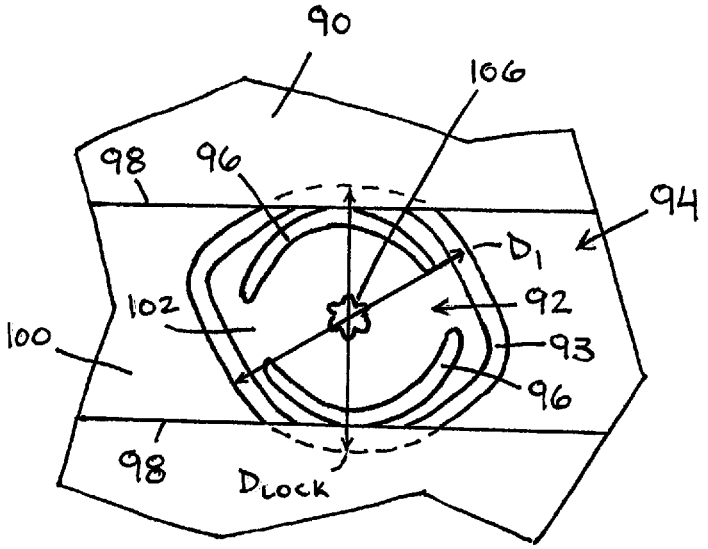
FIG. 15 is a bottom view of a portion of the golf club head of FIG. 12, illustrating a weight member in a locked orientation.
Figure 16:
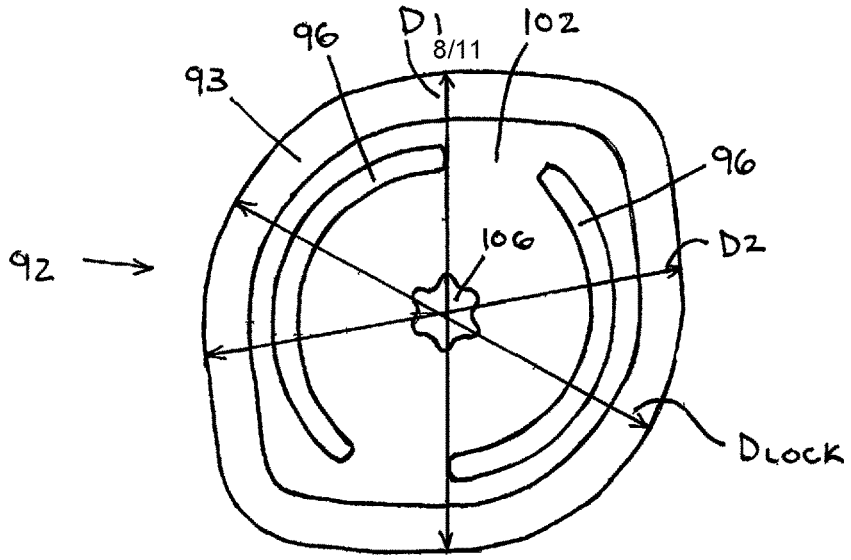
FIG. 16 is a bottom view of the weight member included in the golf club head of FIG. 12.
Figure 17:
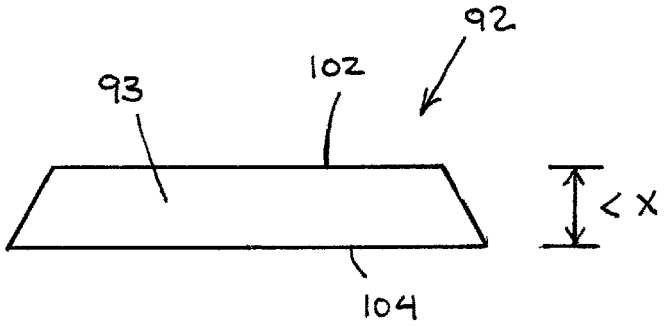
FIG. 17 is a side view of the weight member included in the golf club head of FIG. 12.
Figure 18:
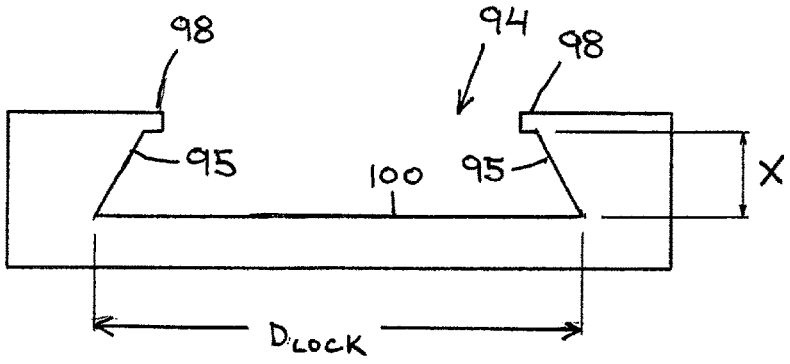
FIG. 18 is a cross-sectional view of the weight track of FIG. 12, taken along line 18-18.

Weight member 10 may be constructed from a single material or it may have a multi-material construction. For example, as shown in FIG. 4, portions of the weight body 12, shown by dashed portions 26, may include recesses or may be constructed of a material having a different specific gravity than the remainder of the weight body to create an insert that is heavier or lighter relative to the weight body. In embodiments having a heavy or light insert, the insert may be joined with the weight body by many different methods, including mechanically fixing the insert to the weight body by threaded engagement, and/or fasteners. Alternatively, the materials may be coupled using metallurgical joining techniques, such as welding, swaging, forging the materials together, or co-casting.

Referring to FIGS. 6-11, a golf club head 30 includes another weight system 32 that provides adjustability of the center of gravity of the golf club head and that is disposed on a body member. The weight system 32 includes weight member 34 and a weight mount in the form of slot 31 extending through at least a portion of the thickness of the body member. Weight member 34 is assembled from a weight body 36, a spring clip 38, a locking member 40, and an optional weight slug 42. Weight member 34 is installed in slot 31, slides along edges of slot 31, and is configured to naturally seat in detent recesses 44 that are included in the edges of slot 31. Preferably, weight member 34 provides an audible and/or tactile "click" when it seats in each of the detent recesses 44 included in slot 31.

Weight body 36 provides the primary source for mass in weight member 34, while providing a frame for supporting spring clip 38. In particular, the weight body 36 includes an outer portion 46 that resides outside of slot 31 when weight member 34 is installed, a clip portion 48 that receives spring clip 38 and resides in slot 31 when weight member 34 is installed, and an inner portion 50 that is sized to extend through slot 31. In the illustrated embodiment, outer portion 46 is a generally cylindrical portion of the weight body 36. Preferably, the outer portion has an outer dimension that prevents it from being inserted into slot 31, so that it limits the insertion of the weight body 36 into slot 31. It should be appreciated that the outer portion 46 need not be cylindrical, and the shape and size of the outer portion 46 may be altered to alter the overall mass of the weight body 36 and weight member 34. Outer portion 46 also includes a locking member mount 52, such as a bore that receives locking member 40 and that extends into clip portion 48. For example, locking member mount 52 may be a threaded bore that threads with a locking member 40 that includes a threaded portion. As a further alternative, outer portion 46 may have a multi-material construction so that the mass of weight body 36 may be altered, such as by replacing a portion of the outer portion 46 indicated by dashed area 57 with a component constructed of a material having a different specific gravity than the material of weight body 36.

The clip portion 48 and inner portion 50 extend from outer portion 46. Clip portion 48 is interposed between outer portion 46 and inner portion 50 of weight body 36 and provides a mounting structure for spring clip 38 on weight body 36. In particular, clip portion 48 includes slots 54 on opposite sides of the weight body 36. Spring clip 38 is disposed on weight body in clip portion 48 so that a portion spring clip 38 resides in slots 54. The configuration of slots 54 results in outer portion 46 and inner portion 50 creating shoulders that straddle spring clip 38 and retain it in the direction of a longitudinal axis of weight body 36. Slots 54 extend through the side wall of the clip portion 48 so that a portion of the spring clip 38 intersects the bore that forms the locking member mount 52 when spring clip 38 is installed on weight body 36.

Inner portion 50 extends away from outer portion 46 and clip portion 48 and is sized so that it may extend through slot 31. In the illustrated embodiment, inner portion 50 is generally an annular cylindrical body that has an outer diameter that is smaller than the width of the opening of slot 31. It should be appreciated that inner portion 50 may include parts that have an outer dimension that is greater than the opening of slot 31, as long as some part of inner portion 50 has an outer dimension that allows it to be inserted into a portion of slot 31. It should also be appreciated that inner portion 50 need not be cylindrical, but may alternatively have a polygonal shape, such as a square or rectangle, or another curved shape. Inner portion 50 may also include a mounting feature for weight slug 42, which may be used to increase the mass of weight member 34. For example, inner portion 50 may include a mount 56 that allows a selected weight slug 42 to be coupled to weight body 36. Mount 56 may be a threaded bore and weight slug 42 may be a threaded weight member that is selected from a plurality of weight slugs 42 having different masses and threaded into mount 56.

Spring clip 38 generally includes two arms 58 that are able to flex toward and away from each other. The arms 58 are coupled by a flexure 60 and terminate at terminal ends 61 that are spaced from each other to define a gap 62. Spring clip 38 also includes locking tabs 64 that extend inward from arms 58. Locking tabs 64 extend through the side wall of clip portion 48 so that they intersect a portion of the bore that forms locking member mount 52.

Each of arms 58 defines an outer channel 66, that is at least partially defined by an outer engagement surface 67, and that receives a portion of the side wall of slot 31. A detent projection 68 is disposed in each outer channel 66 that is shaped and sized to complement the shape and size of the detent recesses 44 included in slot 31. The detent projection 68 is a portion of outer engagement surface 67 that locally extends outward. Spring clip 38 and slot 31 are shaped so that spring clip 38 is biased outward when it is installed in slot 31. As a result, spring clip 38 remains in contact with the edges of slot 31 and creates the force that causes the detent projections 68 to click into the detent recesses 44.

The sizes of the channels 66 and detent projections 68 are selected so that there is minimal clearance between those features and the complementary portions of the slot 31. That minimal clearance allows the weight member 34 to move along slot 31 while preventing additional movement relative to the walls of slot 31. As a further alternative, the edges of slot 31, including detent recesses 44 may be beveled, and the detent projections 68 may be tapered so that when the projections engage the recesses, the weight member 34 is drawn further into slot 31 and against the wall of golf club head 30. Spring clip 38 is constructed so that arms 58 may be spread apart from one another so that clip portion 48 of weight body 36 may be inserted through gap 62 and locking tabs 64 located in slots 54.

Locking member 40 is included to selectively provide support to spring clip 38 to limit inward motion of the locking tabs 64 when the weight member 34 is positioned at a detent location. Locking member 40 is a tapered screw that includes a threaded portion 70 and a tapered tip portion 72. Threaded portion 70 couples with the threaded bore included in outer portion 46 of weight body 36 and allows a user to advance and retract locking member 40 relative to weight body 36. The tapered tip portion 72 extends into clip portion 48 of weight body 36 and is configured to selectively abut an inner surface of locking tabs 64, thereby preventing arms 58 of spring clip 38 from flexing inward toward each other when the weight member 34 is located at a detent. Locking member 40 may also be used to increase the force between the spring clip 38 and the walls of slot 31 by advancing the locking member 40 further into weight body 36 after contact is established between locking tabs 64 and the tapered tip portion 72. Preferably, the locking member 40 is dimensioned so that it requires between ¼ and ½ of a turn of the locking member to disengage the spring clip 38 enough to allow the weight member 34 to slide along slot 31.

In general, the weight member 34 is slid in slot 31 by a user grasping outer portion 46 of weight body 36 and sliding the weight member 34. However, because spring clip 38 is configured to slide against the walls of slot 31 the spring clip 38 may shift in clip portion 48 relative to weight body 36. That shift may cause the spring clip 38 to interact with the side walls of clip portion 48 and locking member 40 which can cause the arms 58 of spring clip 38 to be pushed outward, or spring clip 38 to twist relative to slot 31, thereby increasing the friction between the spring clip 38 and the slot wall and further hindering the ability to slide the weight member in slot 31. Accordingly, features that prevent the relative motion between the spring clip 38 and the other components, and/or features that prevent the arms 58 of spring clip 38 from spreading due to the relative motion are included in the construction of weight member 34. For example, spring clip 38 may include a spacer 74 that is incorporated into flexure 60 that limits both the space between spring clip 38 and clip portion 48 of weight body 36 and the relative motion between the two components. Additionally, spring clip 38 may be shaped to limit a gap 76 between clip portion 48 and the terminal ends 61 of arms 58, and the surface of clip portion 48 closest to terminal ends 61 may include a concavity 78 so that contact between concavity 78 and terminal ends 61 draws arms 58 together. Still further, the width of locking tabs 64 may be selected to closely clear the width of the portions of slots 54 that receive tabs 64 so that the amount of clearance between the locking tabs 64 and slots 54 dictates the range of motion of the spring clip 38 relative to the weight body 36.

In general, slot 31 is only required to be an elongate opening in a wall of the golf club head that includes detent features to interact with weight member 34. It is generally desirable to close the slot so that the interior of the golf club head is not exposed, so a slot cover may be installed to close the interior volume of the golf club head. The cover may be a thin-walled trough or tray that may be glued inside the golf club head to cover the slot and to seal the inner cavity of the golf club head from air, water or other debris.

In another embodiment, shown in FIGS. 12-18, a golf club head 90 includes a weight member 92 that utilizes spring features and a cam shape to lock the weight member 92 into a desired location in a weight mount that is formed by a shallow track 94. The weight member 92 may be rotated in the track 94 between a first, unlocked orientation, shown in FIG. 14, in which a side wall 93 of the weight member 92 is spaced from the side wall of the track 94, and a second, locked orientation, shown in FIG. 15. When the weight member 92 is in the locked orientation, the cam shape results in the side wall 93 of the weight member 92 abutting the side wall 95 of the track 94 and creating an outward, lateral force between track 94 and weight member 92.

Weight member 92 is generally a monolithic weight body that is shaped so that it functions as a cam in track 94, and includes an outer surface 102, an inner surface 104, and side wall 93 extends between outer surface 102 and inner surface 104. In particular, the side wall 93 of weight member 92 is curved and non-circular so that the outer dimension varies with the angular orientation of the weight member 92. In an example, weight member 92 has an oculiform shape, i.e., is shaped like an eye, so that the overall outer dimension taken through a centroid of the weight member varies between a minimum overall outer dimension $D_1$ of 28.5 mm and a maximum overall outer dimension $D_2$ of 30.0 mm. The side wall 93 of the weight member 92 is beveled at an angle in a range of 20° to 40°, and more preferably at an angle of about 30° and the weight member 92 has a thickness of about 4.8 mm. Weight member 92 also includes slots 96 that are generally semi-circular elongate apertures spaced from the side wall 93 so that the side wall 93 forms a spring feature. Preferably, the slot has a width of between about 1.5 mm and about 3.0 mm, and is spaced from the side wall 93 by a distance of about 1.5 mm at outer surface 102 of weight member 92.

Track 94 is generally formed by angled, or beveled, side walls 95 that form undercuts on the sides of the weight mount. The side walls 95 of the track 94, which are preferably parallel to the side wall 93 of weight member 92, are beveled at an angle about equal to the angle of the side wall of the weight member, in particular at an angle of about 30° relative to a bottom wall support surface 104 of track 94. The contact between the beveled side walls during rotation of the weight member 92 relative to track 94 causes weight member 92 to be drawn into the track 94 so that inner surface 104 is forced against support surface 100 of track. The outermost edges of track 94 include ledges 98 that form overhanging shoulders that are spaced from support surface 100 of track 94 by a distance that is greater than the thickness of weight member 92 to provide a gap so that weight member 92 may slide in track 94. Preferably, the distance is greater than the thickness of weight member 92 by about 0.01 inch to about 0.05 inch. The width of the track is selected to allow both locking and sliding of the weight member 92. In particular, the width of the track 94 at each elevation above the support surface 100 is selected to be between a minimum and a maximum outer dimension of the weight member at each corresponding elevation from support surface 100. Additionally, support surface 100 has a value $D_{Lock}$ that is between the minimum overall outer dimension $D_1$ and the maximum overall outer dimension $D_2$ of inner surface 104 of weight member 92 so that the weight member may be locked in place by rotation and cam action.

A tool engagement feature 106 is included in the body of weight member 92 for locking weight member 92 in track. In particular, tool engagement feature 106 is a feature that receives a portion of a tool, such as a screw driver or torque wrench, so that the tool may be used to rotate weight member 92 in track 94.

Figure 19:
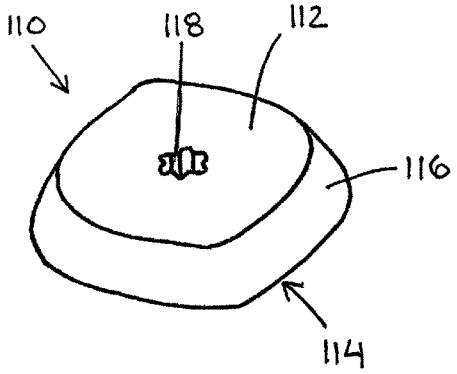
FIG. 19 is a perspective view of an alternative embodiment of the weight of FIG. 17.

Alternative embodiments of a weight member utilizing a cam shape to lock the weight member in place in a shallow track are illustrated in FIGS. 19-22, all of which may have a generally oculiform in shape. Referring to FIG. 19, a weight member 110 is similar to the weight member of FIGS. 12-17, but does not include the spring features formed by slots. Weight member 110 generally includes an outer surface 112, an inner surface 114, a side wall 116, and a tool engagement feature 118. Weight member 110 is shaped to cam against walls of a weight track having beveled side walls, such as weight track 94. The side wall 116 of weight member 110 is beveled to match the side walls of a complementary track and the weight member 110 locks in the track in the same manner as weight member 92 described above.

Figure 20:
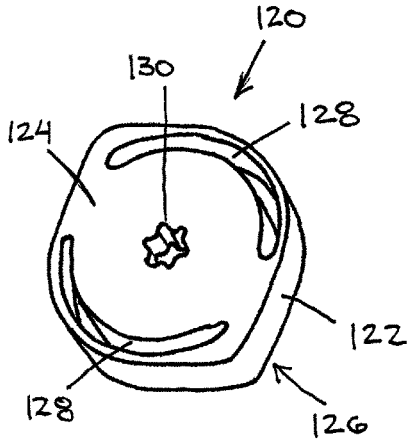
FIG. 20 is a perspective view of another alternative embodiment of the weight of FIG. 17.
Figure 21:
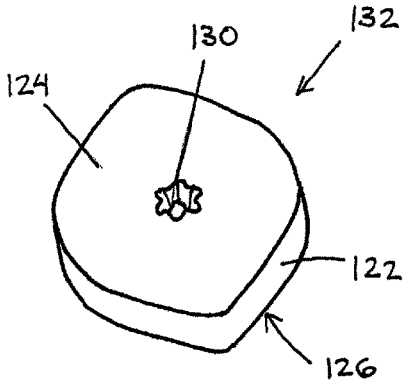
FIG. 21 is a perspective view of another alternative embodiment of the weight of FIG. 17.

Referring to FIG. 20, a weight member 120 including a square side wall 122 will be described. Weight member 120 includes side wall 122 that extends between an outer surface 124 and an inner surface 126 and is generally square in relation to those surfaces, i.e., generally extends from those surfaces at a 90° angle. The side wall of the weight member may be square or beveled. Generally, a square side wall provides only lateral locking force, while a beveled side wall provides both vertical and lateral forces to restrict motion of the weight member relative to the track. As a result, the depth of the track may be selected to prevent relative motion of the weight member relative to the track in a direction orthogonal to the cam force especially for weights having square side walls.

Weight member 120 also includes optional spring features to further lock the weight member into place in the locked position of the cam motion. In particular, slots 128 extend through the body of weight member 120 between outer surface 124 and inner surface 126 near side wall 122. The proximity of slots 128 to side wall 122 results in a portion of the side wall 122 functioning as a spring. Similar to previous embodiments, weight member 120 includes a tool engagement feature 130. As described above, the spring features may be used to increase the cam force between the weight member and the track if needed. However, in some embodiments, that additional spring force is not required, and a weight member 132, shown in FIG. 21, has a construction identical to weight member 120 without the slots forming the spring features, and because of the otherwise identical construction it will not be described further in detail.

Figure 22:
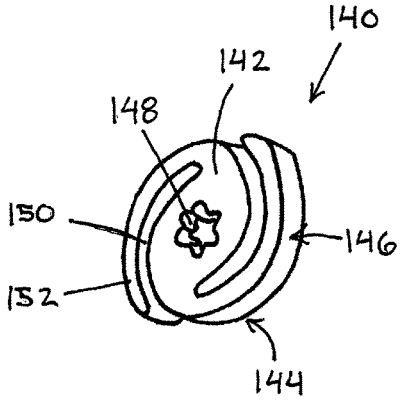
FIG. 22 is a perspective view of another alternative embodiment of the weight of FIG. 17.
Figure 23:
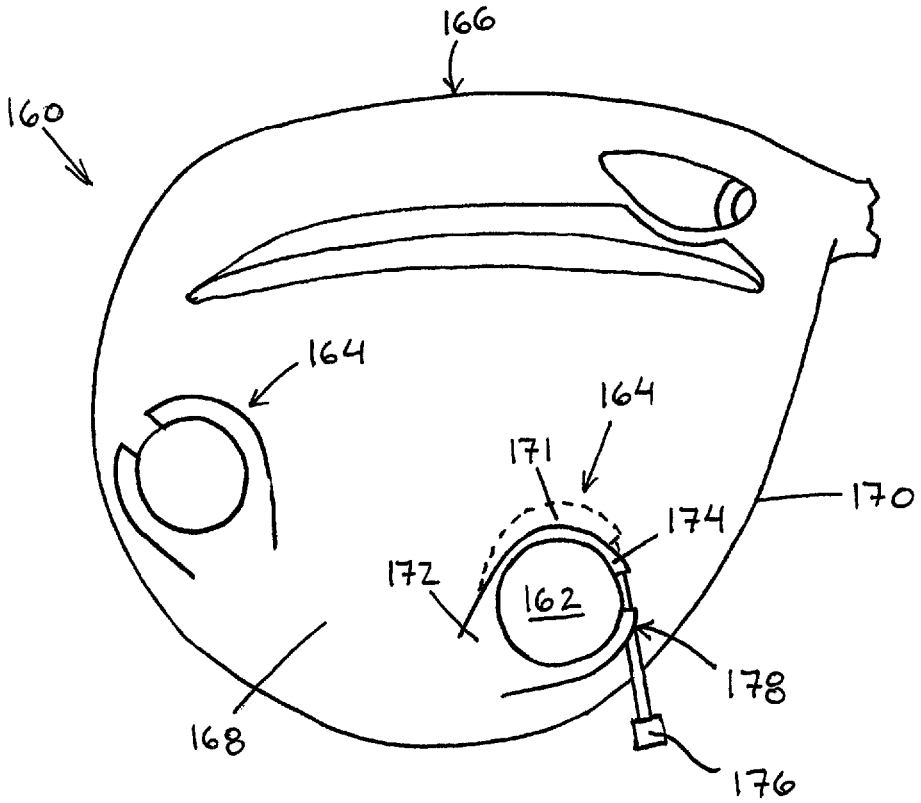
FIG. 23 is a bottom view of a golf club head including another weight member in accordance with the present invention.
Figure 24:
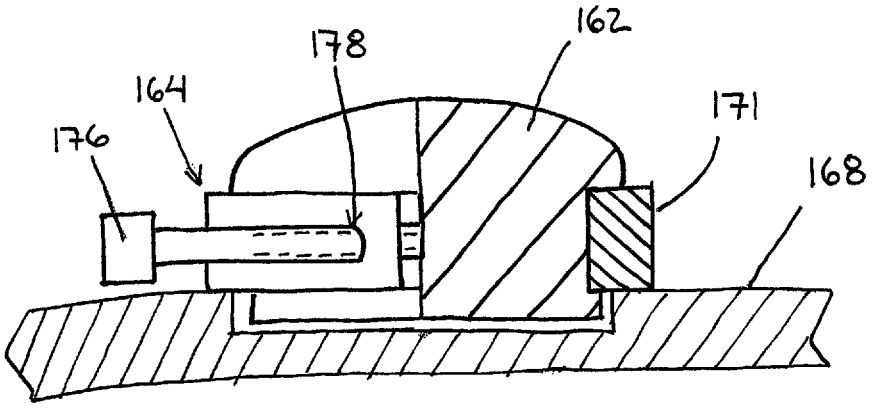
FIG. 24 is a partial cross-section view of the weight receptacle and weight member shown in FIG. 23.

In another embodiment, a weight member 140 includes an alternative construction for spring features and is illustrated in FIG. 22. Weight member 140 includes an outer surface 142, an inner surface 144, a side wall 146 and a tool engagement feature 148. The construction of weight member 140 is similar to the construction of weight member 120 with an alternative spring feature. In particular, weight member 140 includes slots 150 that intersect side wall 146, so that side wall 146 is discontinuous and so that portions of the body of weight member 140 form cantilevered arms 152 that are configured to flex and to provide spring features. All other aspects of the construction of weight member 140 are similar to those described above and will not be further described.

In another embodiment, a golf club head 160 includes a weight member 162 that is captured by a spring clamp 164 that forms a locking portion of a weight receptacle. Golf club head 160 generally is a hollow body defined by a face 166, a sole 168, a crown, and a skirt 170 that extends between the crown and sole 168, and is preferably manufactured by standard methods. The golf club head 160 includes at least one receptacle that accepts and retains the weight member 162, and preferably includes a plurality of weight receptacles.

The spring clamp 164 is configured to be in a naturally clamped configuration, which may be described as an "always-on" configuration. By activating the spring clamp 164 with a tool, the clamp opens and releases the captured weight member 162. A portion of the spring clamp 164 is fixed to a portion of the golf club head 160 and another portion of the spring clamp 164 forms a free end. The spring clamp 164 is preferably integrated into the construction of the golf club head 160, such as by casting the spring clamp 164 into the construction of the body. Alternatively, the spring clamp 164 may be constructed as a separate component and fixed on a portion of the golf club head body, such as by welding or mechanical fasteners.

The spring clamp 164 is affixed at the opening of a receptacle built into the golf club head 160 to form the locking portion of the weight receptacle. Spring clamp 164 is generally formed by at least one flexible arm 171 that includes a fixed end 172 and a free end 174. In the illustrated embodiment, the fixed end 172 is fixedly coupled to a portion of sole 168 and at least one free end 174 extends cantilevered from fixed end 172. Spring clamp 164 is configured as a C-clamp with a spring integrated into the construction of the flexible arm 171 to keep the clamp "on," or closed shut, but it should be appreciated that a separate spring may be incorporated into the spring clamp, such as by incorporating a torsion spring.

A tool 176 is used to open the clamp to permit weight member 162 to be installed in, or removed from, the receptacle. In the illustrated embodiment, tool 176 is threaded into a threaded bore 178 included at a portion of spring clamp 164 near free end 174 of flexible arm 171. An end of tool 176 extends out of threaded bore 178 and abuts free end 174 so that threading tool 176 further into the threaded bore 178 forces the flexible arm to flex outward to open the spring clamp. Unthreading and removing tool 176 from the threaded bore 178 allows the flexible arm 171 to return to its natural position, thereby returning the spring clamp to the natural clamped configuration. Although a threaded tool is illustrated, the tool may be used to open the clamp by different mechanisms. For example, the tool may be configured to act as a lever, push-action, pinch, cam, etc. Additionally, it should be appreciated that more than one arm of the spring clamp may be constructed to be flexible during use. For example, both arms of the illustrated spring clamp 164 may flex when tool 176 is threaded into the threaded bore 178.

Figure 25:
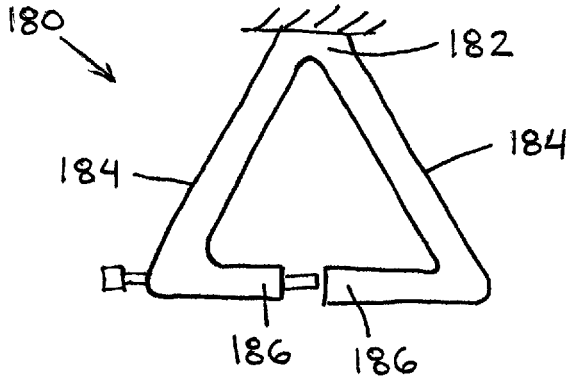
FIG. 25 is a bottom view of an alternative embodiment of the weight receptacle of FIG. 23.
Figure 26:
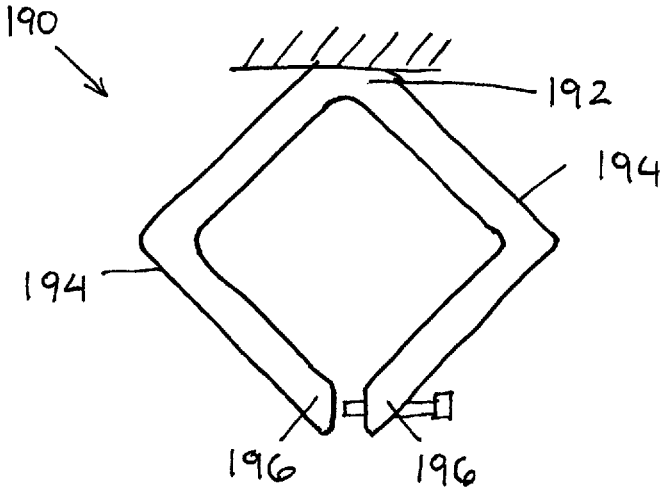
FIG. 26 is a bottom view of an alternative embodiment of the weight receptacle of FIG. 23.

Referring to FIGS. 25 and 26, the spring clamp may have many alternative shapes that provide different advantages. For example, a spring clamp may have a polygonal shape to complement a polygonal weight member and that shape prevents rotation of the weight member in the spring clamp. Referring first to FIG. 25, a spring clamp 180 includes a fixed portion 182 and flexible arms 184 that terminate at free ends 186. Spring clamp 180 has a generally triangular shape that receives a triangular weight member. In another embodiment, shown in FIG. 26, a spring clamp 190 includes a fixed portion 192, and flexible arms 194 that terminate at free ends 196. Spring clamp 190 has a generally rhomboid shape that receives a complementary weight member. It should be appreciated that the spring clamp may have many alternative shapes to complement the shape of a accompanying weight member.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf club head including a weight member, comprising:

club head body comprising a plurality of body members that combine to define a hollow body, wherein the body members include a face defining a ball-striking surface, a sole, a crown, and a skirt, wherein the sole extends aftward from a lower edge of the face, wherein the crown extends aftward from an upper edge of the face, and wherein the skirt extends between the sole and the crown around a perimeter of the body;

a weight mount disposed on at least one of the body members, wherein the weight mount defines a perimeter wall; and a weight member that includes a weight body defining a side wall and at least two spring features, wherein each spring feature is defined by an elongate aperture extending through a thickness of the weight body at a location spaced from the side wall, wherein the weight mount is sized so that the spring features abut the perimeter wall of the weight mount, and wherein the spring features are at least partially flexed laterally by the abutment of the spring feature with the perimeter wall when the weight member is disposed in the weight mount.

2. The golf club head of claim 1, wherein the weight body has an oculiform shape, wherein the weight member is rotatable in the weight mount between a first orientation and a second orientation, wherein rotating the weight member between the first orientation and the second orientation increases a lateral force between the spring feature and the perimeter wall.

3. The golf club head of claim 2, wherein a portion of the weight member at the spring feature has a dimension $D_1$ and a second portion of the weight member at the spring feature has a dimension $D_2$, wherein D2 is greater than D1, wherein the weight mount has a dimension across a portion of the weight mount that abuts the spring feature has a dimension $D_{LOCK}$, and wherein $D_{LOCK}$ is greater than $D_1$ and less than $D_2$.

4. The golf club head of claim 1, wherein translation of the weight member in the weight mount increases a lateral force between the spring feature and the perimeter wall.

5. The golf club head of claim 1, wherein the weight mount includes a perimeter wall that defines an undercut.

6. The golf club head of claim 5, wherein the undercut is formed by a side wall that is angled relative to the bottom wall of the weight mount, and wherein the side wall is angled at about 30° relative to the bottom wall of the weight mount.

7. The golf club head of claim 5, wherein the perimeter wall includes a shoulder overhang, wherein a lower surface of the shoulder overhang is spaced from the bottom wall of the weight mount by a distance that is greater than the thickness of the weight member by about 0.01 inch to about 0.05 inch.

8. The golf club head of claim 1, wherein each spring feature is defined by an elongate aperture extending through a thickness of the weight body at a location spaced from the side wall, wherein the elongate aperture intersects the side wall of the weight body.

9. The golf club head of claim 1, wherein the weight body includes at least three spring features.

10. The golf club head of claim 9, wherein the weight mount includes a bridge member that extends across the weight mount and forms an undercut portion of the weight mount, and wherein at least one of the spring features includes a locking tooth, wherein the locking tooth includes a tapered surface, wherein the tapered surface abuts and slides past a tapered surface on the bridge member when the weight member is installed in the weight mount.

11. A golf club head including a weight member, comprising:

a club head body comprising a plurality of body members that combine to define a hollow body, wherein the body members include a face defining a ball-striking surface, a sole, a crown, and a skirt, wherein the sole extends aftward from a lower edge of the face, wherein the crown extends aftward from an upper edge of the face, and wherein the skirt extends between the sole and the crown around a perimeter of the body;

a weight mount disposed on at least one of the body members, wherein the weight mount is a slot extending through at least a portion of the thickness of the body member, wherein the slot is elongate, and wherein sidewalls of the slot are generally parallel; and a weight member that includes a weight body, a spring clip, and a locking member; wherein the weight body includes an outer portion disposed outward of the body member, an inner portion, and a clip portion interposed between the outer portion and the inner portion, the inner portion extends through the slot toward in interior of the club head body; wherein the spring clip is disposed on the clip portion and includes a plurality of arms separated by a flexure; wherein the width of an outer engagement surface of the spring clip is greater than the width of the slot when the spring clip is in a free state so that the spring clip is compressed when the weight member is installed in the slot; and wherein the locking member extends through the outer portion and into the clip portion of the weight body.

12. The golf club head of claim 11, wherein the sidewalls of the slot include a plurality of detent recesses extending away from a central axis of the elongate slot, and wherein the width of the outer portion of the spring clip is greater than the width of the slot at the detent recesses.

13. The golf club head of claim 12, wherein the spring clip includes a detent projection in the outer engagement surface that extends outward, wherein the detent projection is shaped to complement and fit at least partially into a detent recess.

14. The golf club head of claim 11, wherein the locking member includes a threaded body and a tapered extension, wherein the outer portion of the weight body includes a threaded bore that engages the threaded body of the locking member, wherein the tapered portion extends into the clip portion.

15. The golf club head of claim 14, wherein the locking member abuts a portion of the spring clip when the locking member is extended.

16. A golf club head including a weight member, comprising:

a club head body comprising a plurality of body members that combine to define a hollow body, wherein the body members include a face defining a ball-striking surface, a sole, a crown, and a skirt, wherein the sole extends aftward from a lower edge of the face, wherein the crown extends aftward from an upper edge of the face, and wherein the skirt extends between the sole and the crown around a perimeter of the body;

a weight mount disposed on at least one of the body members, wherein the weight mount is a spring clamp that includes at least one flexible arm, wherein the spring clamp defines an opening that is at least partially defined by the flexible arm, wherein the flexible arm includes a fixed end and a free end, the fixed end is fixedly coupled to the body member, wherein the free end is movable between an opened position and a closed position; and a weight member that includes a weight body, wherein the weight body includes a clamp portion that is disposed in the opening of the spring clamp, wherein the flexible arm forcibly abuts the clamp portion when the free end is in the closed position, wherein the spring clamp is in an always on configuration so that it is naturally clamped on the weight member in the opening defined by the spring clamp.

17. The golf club head of claim 16, wherein the body member includes a recess adjacent the opening in the spring clamp.

18. The golf club head of claim 16, wherein the flexible arm includes a threaded bore that extends through the flexible arm adjacent the free end, and wherein a longitudinal axis of the threaded bore intersects a portion of the spring clamp spaced from the free end by a gap.

19. The golf club head of claim 16, wherein the opening is semi-circular.

20. The golf club head of claim 16, wherein the opening is polygonal.

* * * * *